US006631592B1

(12) United States Patent
Hancock

(10) Patent No.: US 6,631,592 B1
(45) Date of Patent: Oct. 14, 2003

(54) FAIL-SAFE DEVICE

(75) Inventor: Michael Hancock, Cheshire (GB)

(73) Assignee: Dee Associates (Business Consultants) Ltd., Cheshire (GB)

( * ) Notice: Subject to any disclaimer, the term of this patent is extended or adjusted under 35 U.S.C. 154(b) by 0 days.

(21) Appl. No.: 09/673,060

(22) PCT Filed: Apr. 6, 1999

(86) PCT No.: PCT/GB99/01040

§ 371 (c)(1),
(2), (4) Date: Oct. 10, 2000

(87) PCT Pub. No.: WO99/54568

PCT Pub. Date: Oct. 28, 1999

(30) Foreign Application Priority Data

Apr. 18, 1998 (GB) ..... 9808291

(51) Int. Cl.[7] ..... E04B 1/98; E04H 9/02

(52) U.S. Cl. ..... 52/167.4; 52/223.8; 52/223.11; 52/223.13; 52/726.2; 403/46; 403/48; 403/305; 403/333

(58) Field of Search ..... 52/223.1, 223.2, 52/223.8, 223.11, 223.13, 258, 259, 583.1, 167.1, 167.4, 726.1, 726.2; 403/43, 305, 313, 312, 333, 46, 48

(56) References Cited

U.S. PATENT DOCUMENTS 3,850,535 A 11/1974 Howlett et al.
4,081,219 A * 3/1978 Dykmans ..... 403/43
4,743,138 A * 5/1988 Goy ..... 403/337
4,848,405 A * 7/1989 Albrecht ..... 137/884
5,030,052 A * 7/1991 Anderson et al. ..... 411/383
5,305,573 A 4/1994 Baumann
5,459,973 A * 10/1995 Baumann ..... 52/726.1
5,561,956 A 10/1996 Englekirk et al.
5,606,839 A 3/1997 Baumann
5,967,691 A * 10/1999 Lancelot, III ..... 403/313
6,099,196 A * 8/2000 Lancelot, III ..... 403/313
6,325,566 B1 * 12/2001 Devine ..... 403/220
6,328,499 B1 * 12/2001 Reding et al. ..... 403/299

* cited by examiner

*Primary Examiner*—Carl D. Friedman
*Assistant Examiner*—Yvonne M. Horton
(74) *Attorney, Agent, or Firm*—Jenkins, Wilson & Taylor, P.A.

(57) ABSTRACT

The invention concerns fail-safe devices for use in reinforced concrete structures. The device (1) comprises a link (8) of high tensile strength material and first (2) and second (3) end regions. The end regions (2, 3) and the link (8) joining them are formed from a single piece of material. The link (8) is waisted such a portion thereof is of a reduced cross section. The device is designed to yield at a given loading to within close tolerances and enables the design and construction of buildings which will react in a safe way under earthquake conditions.

8 Claims, 4 Drawing Sheets

FAIL-SAFE DEVICE

DESCRIPTION

1. Technical Field

The invention relates to a fail-safe device particularly, but not exclusively, for use in reinforced concrete structures.

2. Background Art

Buildings and other structures are generally designed and built for static situations on the basis of the minimum required strength of their constituent components. As a result, in order to ensure that such minimum design criteria are easily met, many components are over-designed or over-specified and there is little or no perceived penalty in installing stronger components than are actually required.

However, increasingly attention is being paid to the design of structures in areas of the world which are prone to earthquakes and, in such areas, over-design or specification can bring with it inherent problems. For instance, in the past much attention was brought to bear on designs for so-called "earthquake-proof" structures capable of withstanding seismic activity. Unfortunately, as recent experience in Kobe has shown, there really is no such thing as an "earthquake-proof" structure and, when a building finally does give-way it can often occur in an unpredictable and unsafe manner leading to much loss of life.

Engineering design standards in areas prone to earthquakes are still in a state of flux, but a key element in modern design approach is to accept that some earthquakes will be too powerful to withstand.

A European standard, known as Eurocode 8 has been directed toward the issue of building designs in earthquake areas. According to Eurocode 8, a set of prerequisites regarding the mechanical properties of reinforcement bars used in reinforced concrete are detailed. The aim of Eurocode 8 is to maximize safety for building users. Such safety maximization is attained by ensuring that the building will respond in a ductile fashion to seismic activity.

Whilst this Eurocode 8 is in existence, there are a number of problems in implementing it. Earthquakes vary enormously in their magnitude. To adopt the same design methods as are used to accommodate gravity, wind, etc., for dealing with earthquake loads would lead to over design. Since all structures need to be built to an economic level, over-design is simply not practical. Also, if the structure is built to have what might be regarded as an elastic response (i.e. able to take the load and recover fully) then the large values of acceleration which could result in practice from such design methodologies could in themselves endanger lives and cause extensive non-structural damage.

Earthquake-resistant structures are usually designed to respond in a non-linear fashion so that below certain seismic load levels, the structure behaves elastically, but when the load goes above a given value, the structure is designed to deform inelastically without significant loss of strength. Such a design is more economical than a fully elastic approach and allows for seismic loads which are higher than those originally predicted during design.

The capacity of a structure to deform without significant loss of strength, know as ductility, is of paramount importance in earthquake engineering. In general ductility is defined as the ratio of deformation at a given response level to deformation at yield response. Thus, its definition can be applied at section, element or structure level.

Concerning structural ductility, earthquake resistant structures generally now follow a "capacity design philosophy" in which the structure is viewed as having two different types of zones, i.e. zones which are "dissipative" and zones which are "non-dissipative". The dissipative zones are those which are responsible for the mobilization of the desired failure mode, chosen to maximize overall energy absorption capacity and avoid collapse. All other zones are considered non-dissipative. The dissipative zones must be dimensioned first and carefully detailed to possess maximum ductility. Next, the amount and sources of "overstrength" are assessed. Such sources of overstrength include: higher concrete compression strength; confinement; larger area of steel due to the availability of bar diameters; higher yield strength of steel; and strain hardening.

The non-dissipative parts of the structure are then designed to withstand forces which are consistent with the strength of dissipative parts, including sources of overstrength. In this way, the structure can be rendered less sensitive to the characteristics of the input motion, since it can only respond in the ductile mode that was envisaged in the design phase, resulting in increased control to seismic response.

To summarize the above, it has been found that instead of relying upon static design, it is better to limit damage by designing in yield, so allowing structures to flex and compensate in a predictable predetermined way to minimise damage and loss of life rather than risking catastrophic failure of the whole structure and the lives of all the occupants.

Unfortunately, up until now implementing this design ethos has been made very difficult, if not impossible, due to the fact that the reinforcing bars (rebars) used in reinforced concrete structures are obtainable from a wide variety of sources and manufactured to wide tolerances. This means that although it is supplied to conform to minimum strength specifications, these minimum margins may be exceeded by a considerable and highly variable margin.

DISCLOSURE OF THE INVENTION

Accordingly, it is an aim of preferred embodiments of the present invention to provide a fail-safe device for use in reinforced concrete structures which is designed to yield under closely specified predetermined conditions to enable the implementation of fail-safe structures.

According to a first aspect of the invention, there is provided a fail-safe device for use in a reinforced concrete structure, the device comprising an elongate link, for connection with a length of reinforcing bar, wherein the link is designed to yield within predefined tolerances under certain limit load conditions.

Preferably, the limit load conditions are brought about by seismic events such as an earthquake or may be due to sudden impact, explosions or the like.

The device may form part of a reinforcing bar or may be a separate unit with first and second ends for respective connection with first and second lengths of reinforcing bar.

Preferably, the link has a transverse cross sectional area which is greater at end regions than at a region between those end regions.

Preferably, the link has a waisted appearance such that it tapers from end regions thereof towards a middle region.

Preferably, the link is formed of a high tensile strength ductile material, such as a high strength alloy steel.

Preferably, where the device is inserted within a length of reinforcing bar or joined to first and second lengths of reinforcing bar, connections between the device and the bar are full strength connections.

By a full strength connection, it is intended to mean that the connection itself between device and reinforcing bar is at least as strong as the reinforcing bar.

Preferably, the full strength connection is achievable by means of providing end regions of the link with a threaded region and providing end regions of the reinforcing bar with a rolled thread and coupling threaded regions of the link and reinforcing bar together by means of an internally threaded sleeve, wherein a thread minor diameter of the reinforcing bar is arranged to be less than a nominal diameter of the bar but a thread major diameter is arranged to be greater than the nominal diameter of the bar. Such a connecting system is described in PCT application number PCT/GB95/00309, as applied for in the name of CCL Systems Limited.

It is most important that connections between reinforcing bar and the device are made by means of such full strength couplings since it is most important that the link itself should give way under limit load conditions, rather than the coupling between link and reinforcing bar.

Preferably, the tensional force required to cause failure of the link is determined by tensile test measurements of a sample of a material from which the link is manufactured.

Preferably, the link is provided with a finely ground finish and this finish determines tolerances in the tension applied within which yield will occur.

Preferably, the device further comprises a coating or encapsulating layer to protect at least part of the link against a damage. The coating or encapsulating layer may be of a solid substance arranged to provide protection against damage such as may be caused by corrosion, impact, or abrasion.

Preferably, the coating or encapsulating layer is of a resinous substance.

Preferably, the coating or encapsulating layer is separated from the link by a debonding agent.

The fail-safe device is preferably provided with a strain gauge attachment, said attachment including connections to external instrumentation for assessing the stress or strain on the device. The strain gauge attachment may be associated with the device by any suitable means, such as using an adhesive to bond the attachment to the waisted area of the link.

According to a second aspect of the invention, there is provided a structure including one or more fail-safe device in accordance with the first aspect of the invention.

Preferably, the fail-safe device is provided in one or more beams and/or columns of the structure.

According to a third aspect of the invention, there is provided a method of manufacturing a fail-safe device, the method comprising: taking a bar of high tensile strength material and cutting that bar to a predetermined length; taking the predetermined length of the bar and turning a central region thereof in order to provide that central region with a reduced diameter; applying a debonding agent to the reduced diameter region; and encapsulating the central region with a protective substance.

Preferably, the remainder of a bar of material from which the fail-safe device is formed is retained for future reference.

Preferably, the diameter of the central region is determined by carrying out controlled tests on the parent material so as to determine a precise diameter required for a given yield strength.

Preferably, end regions of the device are provided with means for connecting them with one or more reinforcing bars.

Preferably, the means for connecting comprises threading the end regions of the device.

BRIEF DESCRIPTION OF THE DRAWINGS

For a better understanding of the invention, and to show how embodiments of the same may be carried into effect, reference will now be made, by way of example, to the accompanying diagrammatic drawings, in which.

DETAILED DESCRIPTION OF THE INVENTION

As touched on earlier, modern seismic design relies on controlling the inelastic response of structures in order to optimize their ductile behaviour. This is achieved by applying "capacity design" principles whereby areas not intended to contribute to the inelastic response are "over designed" with respect to areas where inelastic deformations are intended. Naturally, the capacity (force and deformation, as well as their relationship) of these dissipative parts should be assessed with a high degree of exactitude. Also, as mentioned earlier, this poses several problems not least of which is the effect of randomness of the properties of steel reinforcing bars in concrete structures. This randomness may be expressed as the ratio of the actual yield strength ($F_{y,\ actual}$) to that used in design ($F_{y,\ nominal}$). For example, in Eurocode 8 this ratio is constrained to 1.25 for medium ductility class and 1.2 for high ductility class. The implication of these figures is that a minimum overstrength factor of 20% to 25% is implicit in the subsequent design provisions, to account solely for the randomness in the steel yield.

By the use of a fail safe link of the type as described in this application hereinafter, this necessary overstrength parameter can be effectively reduced or eliminated to result in more economical structures and better control of inelastic deformation.

Couplers have been widely used for several years for lap splicing of large diameter reinforcement bars, which would require extremely complex and laborious welding procedures, if this conventional procedure was used. Their utilization is particularly common in the design and construction of reinforced concrete (RC) bridges.

Internally threaded couplers are now in common use for joining the externally threaded ends of re-bars together and it is in this context that embodiments of the present invention are particularly suitable.

The invention provides a special fail-safe device as a means for coupling together reinforced concrete bars and for use in seismic design and construction. The fail-safe device described hereinafter allows the installation of a material produced under rigorous control criteria, at dissipative locations only, where the need for such control arises. This not only ensures that the failure mechanism devised can be obtained, but also allows the use of lower over strength factors in the design of non-dissipative zones, where common reinforcement steel should be used.

Figure 1:
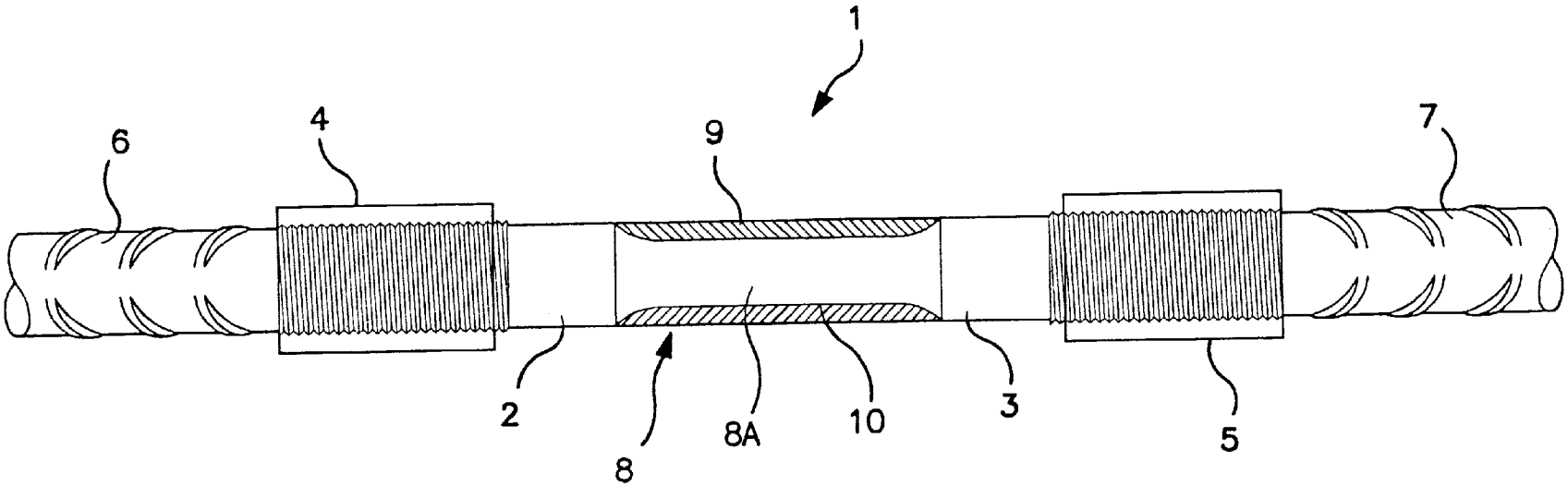
FIG. 1 shows an embodiment of a fail-safe device connected to a pair of reinforcing bars.

Referring to FIG. 1, there is shown a fail-safe device 1 comprising a link 8 of high tensile strength material and first 2 and second 3 end regions. The end regions 2, 3 and the link 8 joining them are formed from a single piece of material. The end regions 2, 3 are at least partially threaded for connection with internally threaded couplers 4, 5, which connect in turn with reinforcing bars 6, 7. The link 8, intermediate the end regions 2 and 3 is waisted such that a portion thereof is of a reduced cross section as compared to parts of the link 8 adjacent to the end regions 2, 3. The waisted part 8A is positioned generally at a mid-region of the link 8 and the transition between the relatively larger diameter end regions 2, 3 and the waisted part is preferably gradual.

The waisted part 8A, being of least diameter is the part of the device which is designed to yield at a given loading and this part is preferably surrounded by a resinous substance 9 and the interface between resinous substance 9 and the waisted part 8A is formed by a debonding agent 10 which is arranged to ensure that the resin 9 does not make any contribution to the tensile strength of the device, that strength being determined by the cross sectional area of the waisted portion 8A of the link 8 alone. The purpose of the resinous substance is to provide a degree of protection and isolation between the critical parts of the device and the concrete which, in use, surrounds it.

The link is preferably formed by machining a bar of high tensile strength material (such as high strength alloy steel) to required dimensions according to a desired yield strength. Surface treatment of the link is finely ground so as to ensure that imperfections, which could affect the failure loading, are minimized or eradicated.

Determining exactly what diameter is required for the waisted region for a given desired failure strength may be achieved by testing samples of the parent material. In this way, limit load conditions may be determined to fine tolerances.

Since it is of paramount importance that the device itself should determine the point at which yield occurs, it is most important that end regions of the device be coupled in such a way to the reinforcing bars 6 and 7 that the coupling itself will not give way before the link. It is highly desirable, in such cases, that the joint comprised of threaded ends of rebars 6, 7 couplers 4, 5 and threaded parts of the end regions 2, 3 of the device 1 should be of a full strength type. Full strength connections between components may be achieved by using the CCL bar X-L coupling system which is described in detail in PCT application number PCT/GB95/00309.

In accordance with the bar X-L system, end regions of the reinforcing bars 6, 7 are skimmed, to reduce any ovalities, and thread rolled onto the skimmed end regions, whereby the thread has a thread minor diameter which is less than a nominal diameter of the reinforcing bar and has a thread major diameter which is greater than a nominal diameter of the reinforcing bar. In this CCL system, although the thread minor is less than the nominal diameter of the rebar, the processing steps and thread form are chosen so as to still provide a full-strength type connection but of a very economical form.

In use, the device may be employed as a "seismic fuse" which is employable within structures situated in known earthquake zones. Typically, such seismic fuses would be installed at various points within a reinforced concrete structure so that optimised designs incorporating prioritised failure can be reliably implemented. The device, once installed, will yield at predetermined loads and elongations when under tension. The applied load tension required to cause such a seismic fuse to yield may be within very small tolerances, such as 5%, of a specified value.

Failure of the seismic fuse will take place in the reduced diameter central section 8A and the length of this section may be varied to accommodate the working space available. The resin encapsulation protects the central "critical" section from load-reducing damage caused by corrosion and impact, but is separated from the metal surface by the debonding agent 10.

Each seismic fuse may be permanently marked during manufacture with an identifying icon or number which allows a sample of the original parent bar of material and its related test results, and other manufacturing data to be traced.

Figure 2:
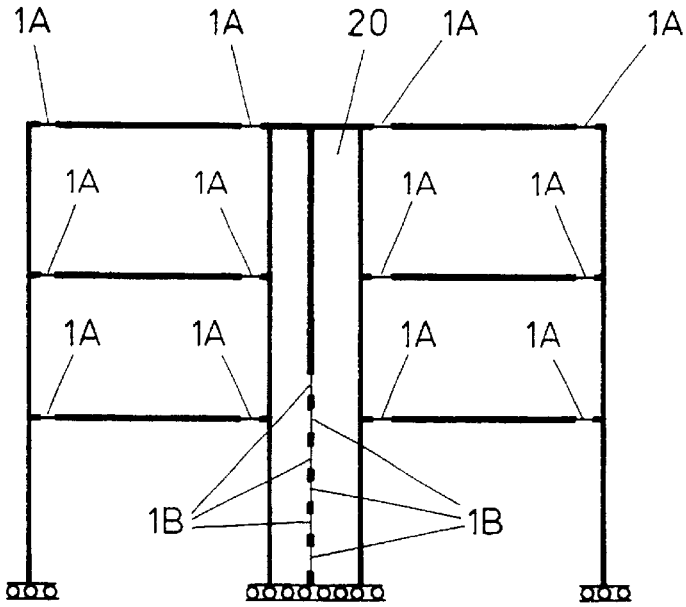
FIG. 2 is a schematic diagram showing possible placement of fail-safe devices within a column.

A tensile scheme is proposed in FIG. 2 to illustrate the potential of the use of such seismic fuses in the global improvement of structure behavior.

Seismic fuses, also referred to herein as "inserts", 1A (such as those shown in FIG. 1) used at beam edge regions will guarantee that plastic hinges do not occur in columns, without the need for large overstrength factors. The sequence of inserts 1B used in a wall element 20 can be used to provide a sequence of plastic hinging, which enables the development of a ductile and controlled inelastic behaviour of the structure. The length of the plastic hinge, thus the level of ductility of the wall, is in this case under tight control of the design engineer and becomes independent of the strain hardening properties of the steel reinforcing bars.

The inserts work as strategically distributed fuses in the structural system providing the design engineer with a reliable tool for earthquake-resistant design and code verification. In this way, Eurocode 8 requirements for the design of high ductility structures can be more easily met. Moreover, high quality steel is needed only in smaller quantities, thus the solution is not expensive. Consequently, the resulting design and detailing of earthquake resistant structures is more economical, whilst the level of confidence in their dynamic response becomes greater.

A number of tests were designed to investigate the feasibility of using the seismic fuses to trigger yield in predefined locations in reinforced concrete flexiural members (with small axial load). The objective being to use high quality special steel alloys that have a very low $F_{y,\ actual}/F_{y,\ nominal}$ value and which exhibit desirable performance characteristics under seismic loading conditions. Such alloys are clearly uneconomical for mass use in structures, but inserting them in short lengths at plastic hinge locations is perfectly feasible.

Figure 3:
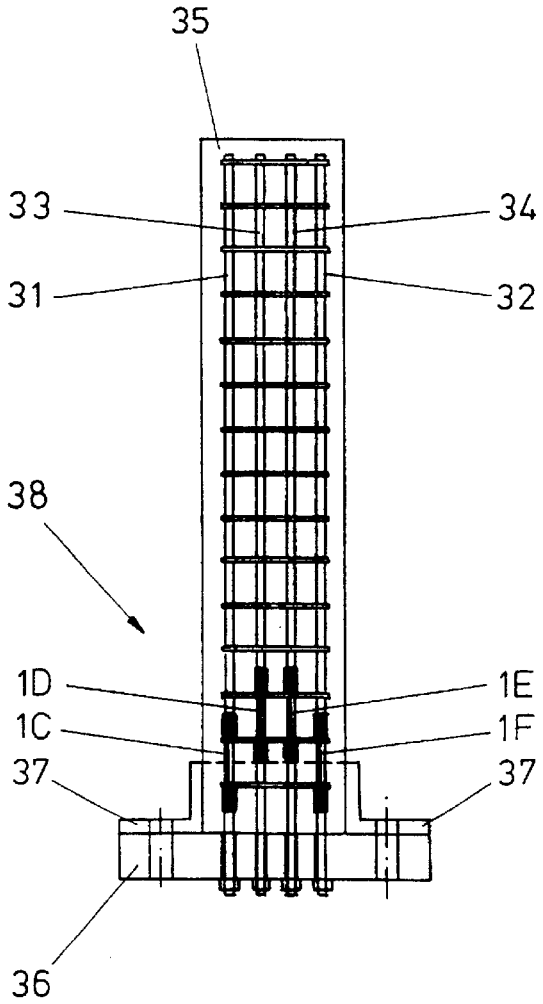
FIG. 3 shows a testing arrangement for testing the placement and efficacity of the fail-safe devices.

FIG. 3 shows schematically a test arrangement with outer rebars 31, 32, inner rebars 33, 34 with a number of inserts 1C–1F joined to them and forming a reinforced concrete column 35. The column is fixed to a baseplate and provided with a collar 37 and, in total is referred to as a "model assembly" 38. Table 1 gives the overall description of the number of inserts 1C to 1F used in the various tests.

TABLE 1

| Experimental Test Members - Insert Details. | | | | |
|---|---|---|---|---|
| | No. of inserts (N) and distance (L) from critical section | | | |
| Test | Outer Bars | | Inner Bars | |
| ref | N | L | N | L |
| 1 | 0 | — | 0 | — |
| 13-2 | 2 | 0 | 0 | — |
| 13-3a | 2 | 0 | 2 | 80 |
| 13-3b | 2 | 0 | 2 | 80 |

The longitudinal reinforcement outer bars 31, 32 and inner bars 33, 34 in this case are deformed type bars of 16 mm diameter produced by a UK manufacturer to comply with the requirements of British Standard BS4449 to achieve a nominal yield strength of 460 MPa. The actual yield strength derived from full tensile tests was found to be 540 MPa, thus resulting in an $F_{y,\ actual}/F_{y,\ nominal}$ value of 1.17 which is within the limit stipulated for the ductility classes of Eurocode 8.

Figure 4:
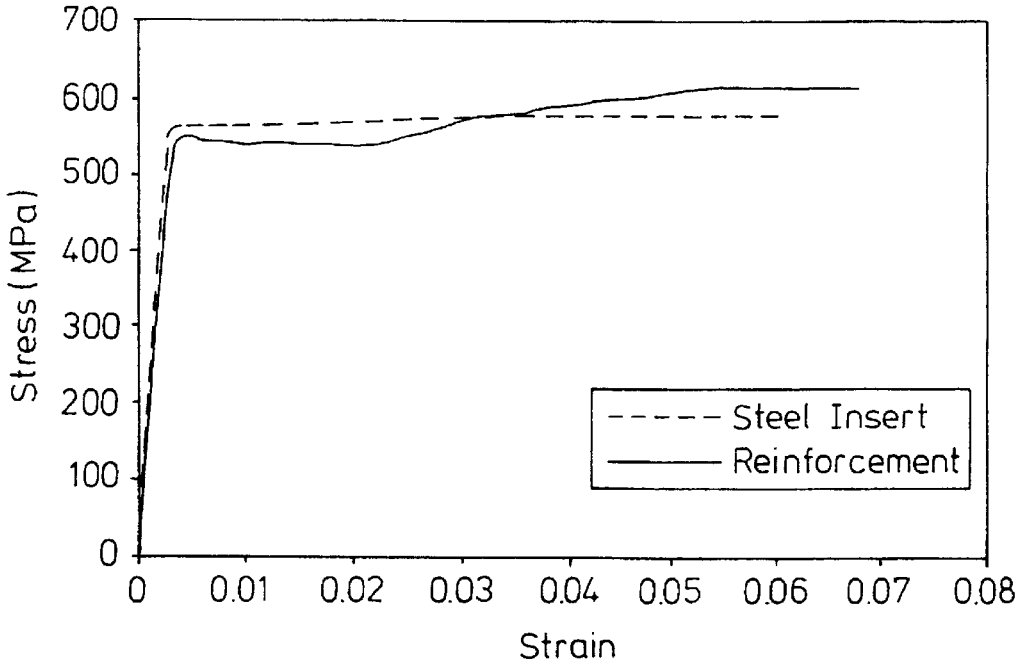
FIG. 4 is a graph showing experimental results relating to stress/strain characteristics of reinforcing bars and the fail-safe device.

The stress/strain characteristics of the reinforcing bar (solid line) is plotted in FIG. 4 along with the experimentally derived relationship for the chosen steel insert material (broken line). The yield value of the insert is approximately 560 MPa which is almost equivalent to that of the reinforcement. Ideally, this yield value should be less than the reinforcement, thus ensuring that an insert equal in diameter to the reinforcement will yield first. However, this was actually found to be achieved by using a reduced diameter of 13 mm for the inserts.

Figure 5:
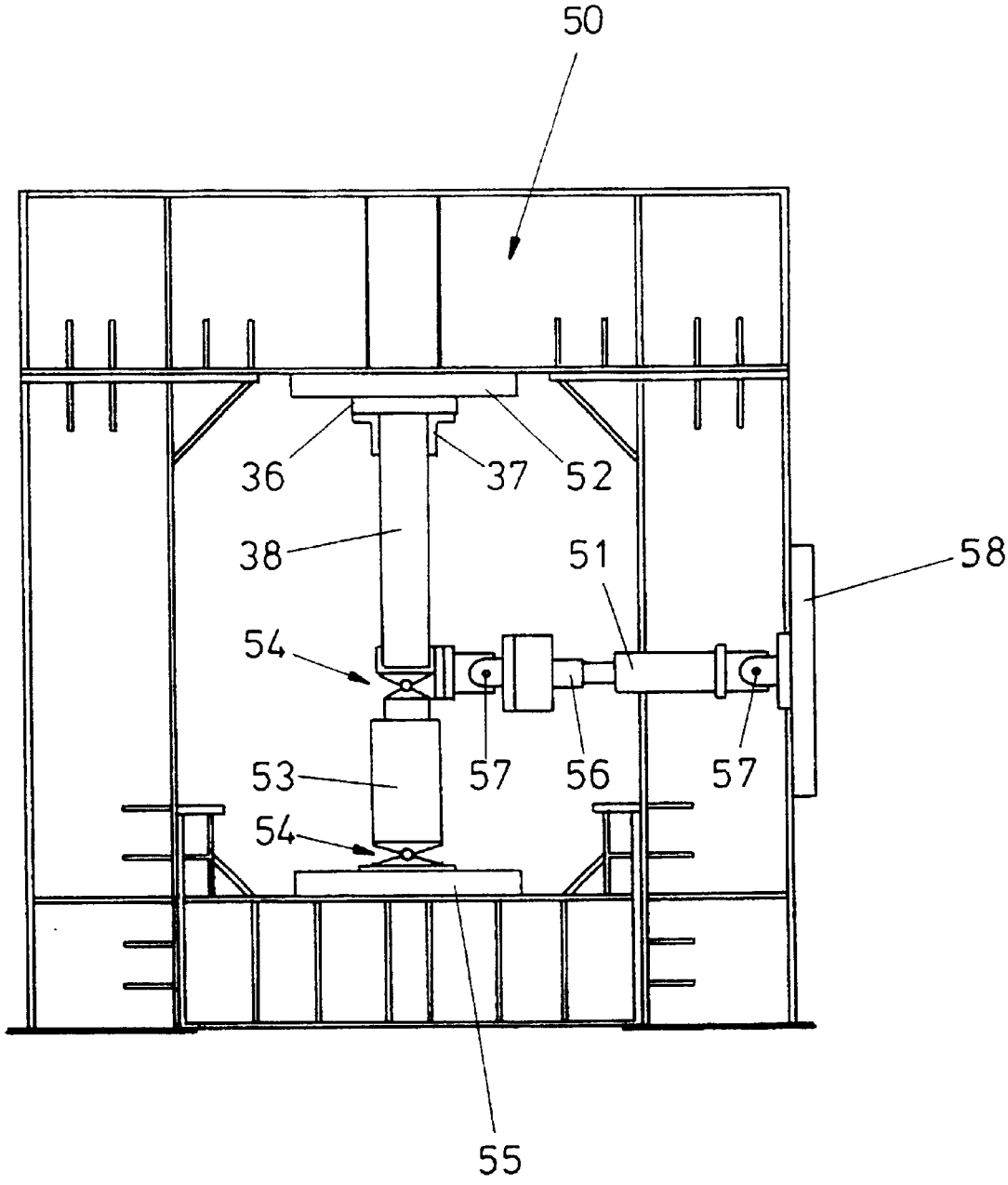
FIG. 5 shows a test rig for testing column members of the type shown in FIG. 3.

Constructed beam/column members of the type shown in FIG. 3 were transferred to an internal reaction steel framed test rig as illustrated in FIG. 5. The model assembly 38 is placed inverted into an internal reaction frame (shown generally as 50) for simplicity in installing and removing each of the models 38 without having to disturb horizontal loading jack 51 or axial loading jack 53. The model base plate 36 and collar 37 are clamped to a top plate 52 of the test rig by high-stress steel threaded bars (not shown). A constant axial load of 10% of the gross axial capacity of the section is applied to the model assembly 38 by means of an axial loading jack 53 connected via ball seating arrangements 54 at either end to the model assembly 38 and to a horizontal baseplate 55 of the frame 50. A displacement controlled horizontal loading history is applied hydraulically via a servo-controller by means of horizontal loading jack 51, load cell 56, and hinge arrangements 57, one of which is positioned between lead cell 56 and model assembly 38, and the other of which is positioned between jack 51 and a vertical baseplate member 58. The initial horizontal displacement was applied monotonically up to a maximum of 60 mm. The displacement was then reduced to zero and subsequently reloaded up to 60 mm, this was repeated until failure or significant degradation of the model occurred.

Experimental output throughout each test was automatically recorded by a datalogger system onto computer. Loads and displacements from both the horizontal and vertical jacks were recorded, as well as strains from the internal electronic gauges placed on both the inserts and longitudinal reinforcement.

The ultimate horizontal strength of the models is calculated as the maximum resolution of the jack forces at each displacement of the model. The capacity of each of the preferred models is listed in Table 2.

TABLE 2

| Experimental results for horizontal load-displacement capacity and ductility. | | | | | |
|---|---|---|---|---|---|
| | Model | 1 | 13-2 | 13-3a | 13-3b |
| Ultimate Strength | Horiz Load (kN) | 68.5 | 56.1 | 55.1 | 54.6 |
| | Horiz Displ. (mm) | 26.1 | 19.7 | 17.7 | 16.7 |
| Displacement Ductility | Yield Displ. (mm) | 11.0 | 10.3 | 9.4 | 9.1 |
| | Failure Displ. (mm) | 49.0 | 32.5 | 33.6 | 33.5 |
| | Ductility | 4.5 | 3.2 | 3.6 | 3.6 |
| Moment Capacity (kNm) | Experimental | 79.6 | 65.0 | 63.8 | 62.8 |
| | Nominal Design | 67.5 | 65.0 | 63.0 | 62.0 |
| | Over-strength | 1.19 | 1.0 | 1.0 | 1.0 |

The values confirm the reduction in the load capacity for the models with the steel inserts as expected and indicates good correlation with each other.

The model capacities for each of the members were calculated from the recorded experimental external loads and compared to the nominal design values in Table 2. The nominal design values were calculated for each table using the actual concrete compressive strength on the day of testing, coupled with the reinforcing steel yield value of 460 MPa for model 1 and 560 MPAa for the inserts in the remaining members. By knowing the initial yield strength of the inserts, since they are presumably of high quality, low variability alloys, the overstrength observed of 19% can be eliminated.

To give a specific example of the insert quality and tolerances, a 20 mm bar of steel made to B5970-part 1: 230M07 was tested and certified to a proof stress of 560 MPa. This was processed to form an insert as described, with a centre section reduced to 13 mm diameter with a machining tolerance of +/−0.1 mm. Whereas re-bar properties could be predicted to within only 17%, the yield properties of the insert produced in this way were found to be predictable to 1.5%. To achieve an insert having the equivalent nominal yield value of the rebar (460 MPa=92,500 Newtons), a steel bar to the BS specifications given should be machined to have a reduced diameter in the critical "waisted" region of 14.5 mm giving a predictable yield at 92845 Newtons±1280.

Figure 6:
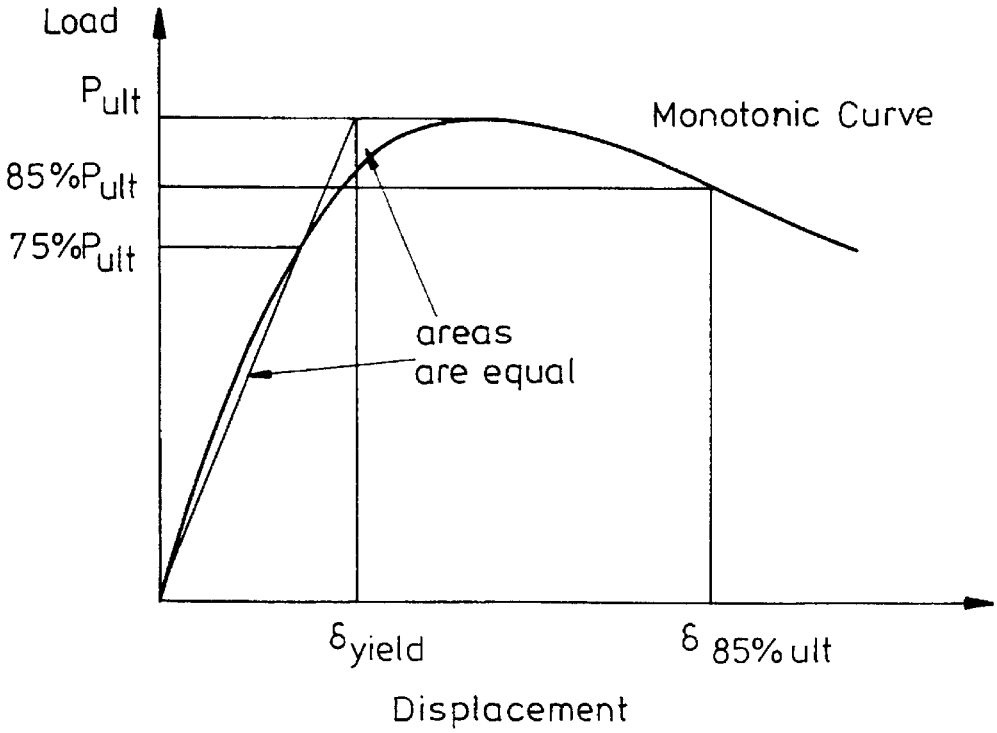
FIG. 6 is a graph showing load versus displacement of a test column showing the yield point.

Table 2 also lists the experimentally derived values of the deflection ductility for each member. This is defined as the ratio of the horizontal displacement at failure to that at yield. For comparison purposes between the models the section yield deflection is found from the Bertero and Mahin approach as recommend by Park [Park, R., Ductility evaluation from laboratory and analytical testing. *Proceedings of the 9th World Conference on Earthquake Engineering, Tokyo-Keoto, Japan, Volume VII,* PP. 605–616, Balkema, Rotterdam. 1998.] It is assumed to be at the intersection of a horizontal line to the ultimate load and a straight line drawn from the origin through a point on the rising envelope of the cyclic curve, which produces an equal area above and below the curve. Failure is taken to be at the level of 85% of ultimate load capacity on the descending branch, i.e. it is deemed that at this point the member is no longer capable of supporting design load levels. These levels are clarified in FIG. 6.

The derived ductility values again show a decrease with the introduction of the steel inserts due to the decreased cross-sectional area, but not withstanding this again the values for the models with the inserts are very similar.

In conclusion, the use of high quality control steel inserts between reinforced concrete bars and used to couple such bars together in a threaded manner is feasible within the plastic hinge zones of reinforced concrete members. The test results indicate that using more than one row of inserts has an influence on the plastic hinge length and hence the member ductility. Therefore, the steel fuse inserts can control not only the yield point, but also the plastic hinge length. It is also clear that overstrength of reinforced concrete members can be accurately predicted and controlled by using seismic fuses of the type described herein. Therefore, capacity design of reinforced concrete members can be achieved easier and more economically.

It will be appreciated that the invention extends to the use of seismic fuses as described herein to enable an assembly or configuration or design of reinforcement used in any part of or member of a reinforced concrete structure to conform to international agreed standards of performance or specifications which have been set to reduce the impact of earthquakes on buildings and structures, such as Eurocode 8.

The invention also includes the positioning of inserts in parts and members of reinforced concrete structures in a way which accords with established design rules and prior art and so ensure that a ductile structure response is achieved.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A method of manufacturing a fail-safe device, the method comprising: taking a bar of high tensile strength material and cutting the bar to a predetermined length to form a reduced length rod having first and second ends (2, 3) with a link region (8) between said first and second ends; taking the reduced length rod and turning the link region (8) in order to provide at least part of the link region (8) with a reduced diameter such that the link region (8) is designed to yield within predefined tolerances, the yield point being controllable dependent upon the reduced diameter; and forming connection means at the first and second ends.

2. A method according to claim 1, wherein the link region (8) is provided with a finely ground surface finish which determines to an extent the tolerances in the applied load within which yield will occur.

3. A fail-safe device for use in a reinforced concrete structure, the device comprising an elongate link, and first and second ends to either side of said link, the first and second ends being arranged to enable connection of the device with a length of reinforcing bar, wherein the link is designed to yield within predefined tolerances under certain load conditions; the device further comprising a coating or encapsulating layer to protect at least part of the link against damage; wherein the coating or encapsulating layer is separated from the elongate link by a debonding agent.

4. A method of manufacturing a fail-safe device, the method comprising: taking a bar of high tensile strength material and cutting the bar to a predetermined length to form a reduced length rod having first and second ends with a link region between said first and second ends; taking the reduced length rod and turning the link region in order to provide at least part of the link region with a reduced diameter such that the link region is designed to yield within predefined tolerances, the yield point being controllable dependent upon the reduced diameter; forming connection means at the first and second ends; applying a debonding agent to the reduced diameter region; and encapsulating the reduced diameter region with a protective substance.

5. A method according to claim 4, in which end regions of the device are provided with means for connecting the end regions with one or more reinforcing bars.

6. A method according to claim 5, in which the means for connecting comprises threading the end regions of the device.

7. A method of manufacturing a fail-safe device, the method comprising: taking a bar of high tensile strength material and cutting the bar to a predetermined length to form a reduced length rod having first and second ends with a link region between said first and second ends; taking the reduced length rod and turning the link region in order to provide at least part of the link region with a reduced diameter such that the link region is designed to yield within predefined tolerances, the yield point being controllable dependent upon the reduced diameter; forming connection means at the first and second ends; wherein the link region is provided with a finely ground surface finish which determines to an extent the tolerances in the applied load within which yield will occur; and wherein the remainder of a bar of material from which the fail-safe device is formed is retained for future reference as a sample of "parent material".

8. A method according to claim 7, in which the diameter of the central region is determined by carrying out controlled tests on the parent material so as to determine a precise diameter required for a given yield strength.

* * * * *